United States Patent [19]

Hershock

[11] 4,321,813

[45] Mar. 30, 1982

[54] PUSHER BLOCK FOR ROTARY FORGING MACHINES AND METHOD OF USING SAME

[75] Inventor: Bruce N. Hershock, Lancaster, Pa.

[73] Assignee: Caterpillar Tractor Co., Peoria, Ill.

[21] Appl. No.: 127,998

[22] PCT Filed: Jan. 7, 1980

[86] PCT No.: PCT/US80/00016

§ 371 Date: Jan. 7, 1980

§ 102(e) Date: Jan. 7, 1980

[51] Int. Cl.[3] ..... B21J 13/12

[52] U.S. Cl. ..... 72/76; 72/420; 72/422

[58] Field of Search ..... 72/76, 420, 422; 82/40; 279/76, 1 B, 1 SG, 102, 103

[56] References Cited

U.S. PATENT DOCUMENTS

| | | | |
|---|---|---|---|
| 515,376 | 2/1894 | Taft | 72/76 |
| 1,332,798 | 3/1920 | Brown | 72/420 |
| 1,469,833 | 10/1923 | Hanson | 82/40 |
| 2,512,484 | 6/1950 | Cornell | 72/76 |
| 2,624,224 | 1/1953 | Ashton | 82/40 |
| 2,827,817 | 3/1958 | Johnson | 82/40 |
| 3,213,951 | 10/1965 | Eeles | 279/103 |
| 3,753,365 | 8/1973 | Kralowetz | 72/76 |
| 3,927,449 | 12/1975 | Gibble et al. . | |

*Primary Examiner*—Lowell A. Larson
*Attorney, Agent, or Firm*—Phillips, Moore, Weissenberger, Lempio & Majestic

[57] ABSTRACT

A conventional rotary forging machine (M) includes a chuck (C) for gripping a workpiece (W) for moving it axially and for rotating the workpiece during the upset forging operation. The chuck may tend to deform the workpiece and relative axial and rotational movement may occur between the workpiece and chuck, thus requiring a prolonged cycle time for the operation. This invention overcomes the above problems by providing a pusher block (10) having grippers (17) thereon for engaging an end of the workpiece to push it through a pair of forging dies (D) and for simultaneously gripping and rotating the workpiece to prevent relative rotation therebetween. In carrying forth the method of this invention, the pusher block engages an annular (W') of the workpiece.

9 Claims, 4 Drawing Figures

PUSHER BLOCK FOR ROTARY FORGING MACHINES AND METHOD OF USING SAME

TECHNICAL FIELD

This invention relates generally to a pusher block and method for forging tubular articles, and more particularly relates to a pusher block and method for engaging a workpiece to move it longitudinally through a forging die while simultaneously rotating the workpiece to form track roller shafts and the like.

BACKGROUND ART

The advent of rotary forging machines has made it possible to expeditiously and accurately form tubular articles, such as track roller shafts. The machine essentially functions to reduce the cross-sectional area or shapes of billets, bars, and tubes by repeated radial strokes with a pair of opposed die parts. The workpiece is fed longitudinally through the die and rotated simultaneously therein to force the material into the desired shape by a series of short, rapid strokes of the die parts. During the forging of a track roller shaft, for example, an expandable chuck of the machine is clamped onto an end of a pre-formed shell portion of the shaft and the chuck is moved longitudinally towards the die and simultaneously rotated, whereby an end of the shaft may be reduced to a predetermined diameter.

Gripping of the shaft with the chuck tends to deform the shaft, thus requiring subsequent machining thereof. In addition, slippage can occur between the rotating chuck and the shaft, thus requiring a prolonged cycle time for forging the shaft into the desired configuration. Such relative slippage can occur both in a rotational direction as well as axially. For example, in one application, a cycle time of approximately 110 seconds was required to form the end of the shaft into the desired configuration. In contrast thereto, the pusher block and method of this invention has been found to reduce such cycle time to approximately 47 seconds. Another problem with conventional forging machines and methods of this type is that securance of the shaft within the chuck required longitudinal movement of the workpiece a substantial distance, thus adding to the above cycle time.

The present invention is directed to overcoming one or more of the problems as set forth above.

DISCLOSURE OF INVENTION

In one aspect of this invention, a pusher block for a rotary forging machine comprises a tubular portion, attachment means for detachably securing the pusher block to a rotating spindle of a rotary forging machine, and gripping means secured on an end of the tubular portion for moving a workpiece axially and simultaneously frictionally gripping and rotating the workpiece upon rotation of the spindle and for preventing relative rotation between the pusher block and workpiece.

In another aspect of this invention, a method for forging a workpiece, having a reduced diameter portion defining an annular shoulder, comprises the steps of gripping the workpiece at the annular shoulder thereof with a pusher block while simultaneously mounting the reduced diameter portion within the pusher block, rotating the pusher block to rotate the workpiece while simultaneously maintaining a gripping force preventing relative rotational slippage therebetween, moving the workpiece axially between a pair of radial movable forming dies, and upsetting the portion of the workpiece being worked on by reciprocating the dies radially and into engagement with the workpiece.

The above pusher block and method thus provide for the expeditious upset forging of a workpiece, such as a track roller shaft employed in a track-type vehicle, while yet preventing damage to the workpiece which normally would require subsequent machining thereof. In addition, the normal cycle time for completing the operation is substantially reduced, due in part to the ability to dispense with an expandable chuck of the rotary forging machine.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
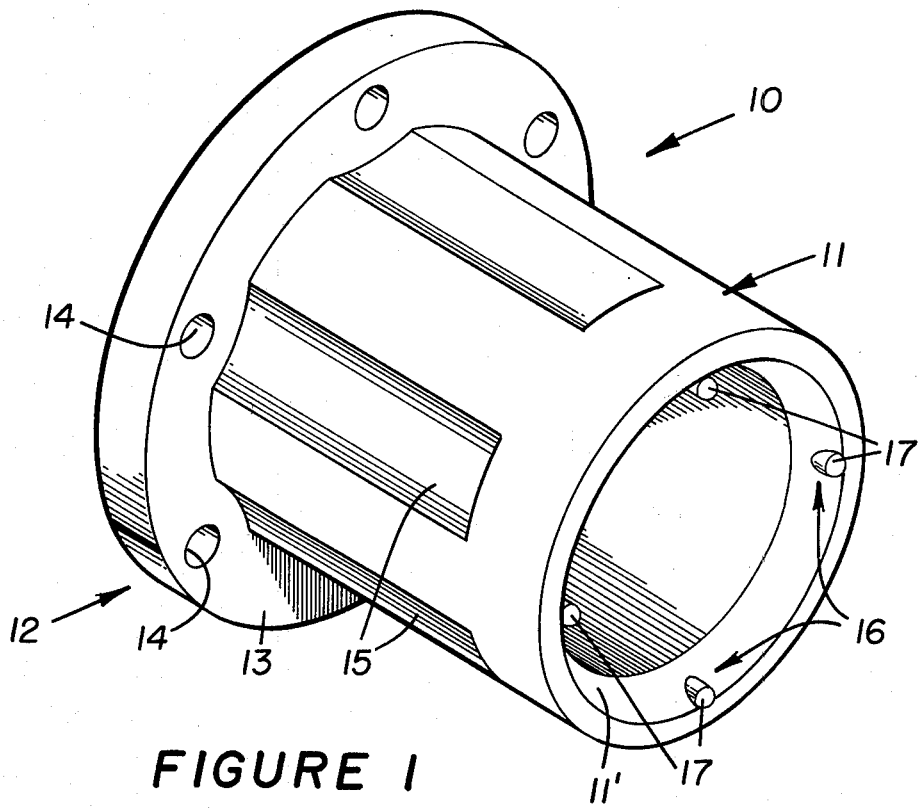
FIG. 1 is a front isometric view illustrating a pusher block embodiment of the present invention.
Figure 3:
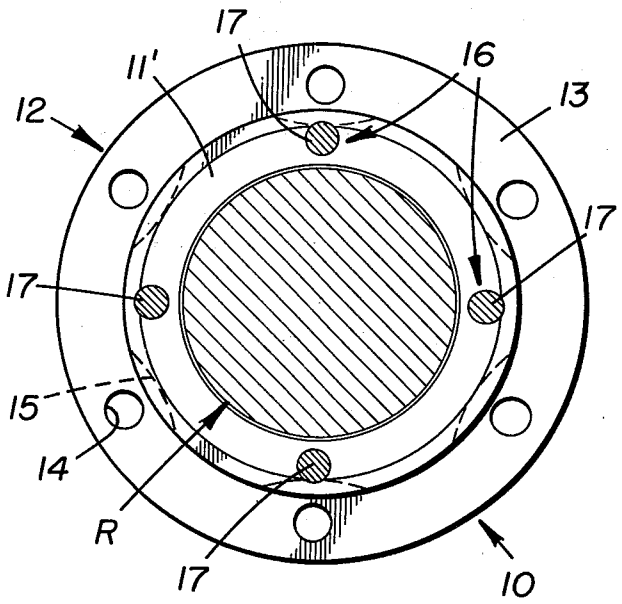
FIG. 3 is a cross-sectional view, taken in the direction of arrows III—III in FIG. 2.
Figure 2:
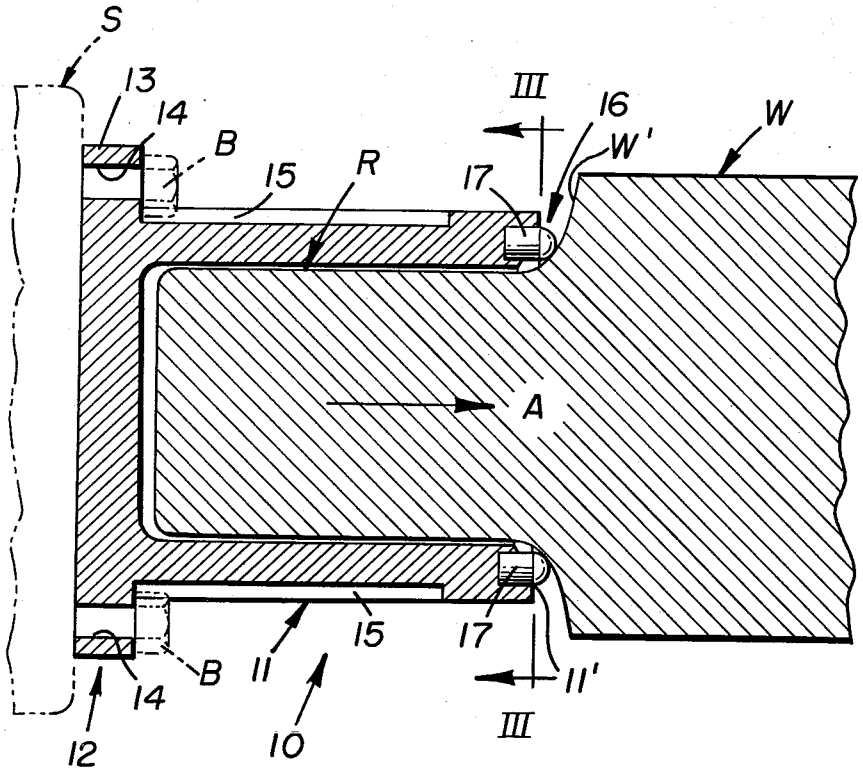
FIG. 2 is a longitudinal cross-sectional view showing the pusher block mounted on a spindle of a rotary forging machine and engaging a workpiece during an upset forging operation.

FIGS. 1–3 illustrate a pusher block 10 adapted for use in a rotary forging machine for moving a workpiece W axially through a pair of radially movable forging die parts D (one shown in FIG. 4) and rotating the workpiece simultaneously. In the specific method hereinafter described, pusher block 10 is disclosed in association with a workpiece which takes the form of a track roller shaft, employed in a track-type vehicle. However, it should be understood that pusher block 10 and the method described are also useful for the upset forging of other types of tubular workpieces, as will be obvious to those skilled in the arts relating hereto.

Figure 4:
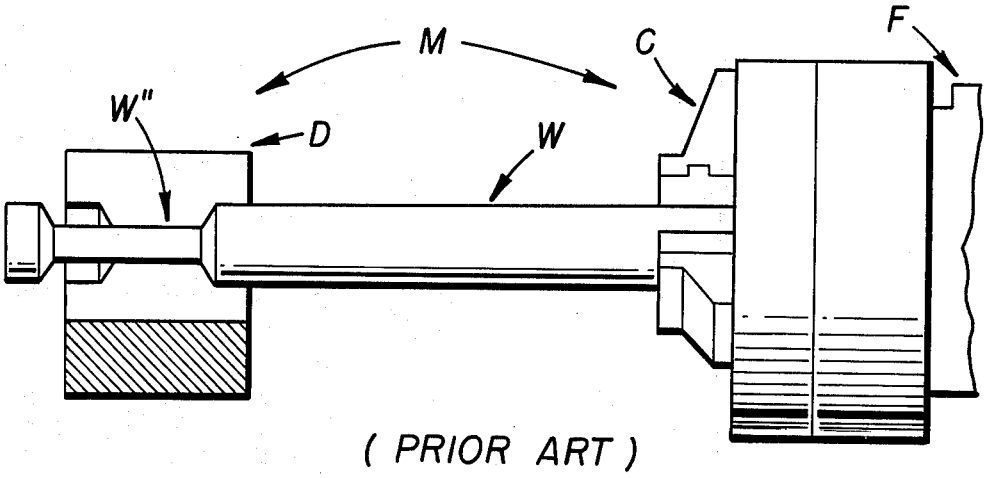
( PRIOR ART ) FIGURE 4
FIG. 4 illustrates a conventional rotary forging machine having a workpiece mounted in an expandable chuck thereof during an upset forging operation.

FIG. 4 illustrates a conventional rotary forging machine M having a chuck C mounted on a feed housing F, which functions to move workpiece W axially through a pair of forging dies D (one shown) while simultaneously rotating the workpiece. The primary problems with this type of machine and the method performed thereby is that the workpiece will tend to slip in chuck C whereby relative rotation occurs therebetween to effect a relatively long cycle time for the forging operation. The prolonged cycle time is also due in part to the substantial distance the workpiece must be moved during the upset forging process since the workpiece is necessarily clamped within chuck C.

For example, in one application it was found that the cycle time for effecting such operation with conventional rotary forging machine M approximated 110 seconds, whereas the same operation was accomplished by pusher block 10 and the method of this invention in approximately 47 seconds. This time saving is, of course, very important when one considers the substantial mass-production of track roller shafts and the like. In addition, chuck C necessarily grips the large, outer diameter of track roller shaft or workpiece W to cause some scoring thereof, requiring subsequent machining.

Pusher block 10 and the method hereinafter described overcome such problems. Referring once again to FIGS. 1–3, pusher block 10 comprises a tubular portion 11, preferably cylindrical, having an attachment means 12 secured adjacent to a first end thereof for detachably securing the pusher block to a rotary chuck C (FIG. 2) by a plurality of bolts B. Attachment means 10 preferably includes a radial flange 13 and a plurality of bolt holes 14 for receiving bolts B, although other types of standard attachment means could be utilized in lieu thereof, as will be appreciated by those skilled in the arts relating hereto. A plurality of axially extending recesses 15 are formed on the periphery of tubular portion 11 with each recess being aligned axially with a respective bolt hole 14 to accommodate the head of a bolt B.

Pusher block 10 has an annular surface 11' formed on a second end thereof which is rounded and convex when viewed in cross-section (FIG. 2). A gripping means 16 is secured adjacent to the second end of tubular portion 11 of pusher block 10 for moving workpiece W axially and for simultaneously gripping and rotating workpiece W upon rotation of chuck C and to prevent relative rotation between the pusher block and workpiece. In the embodiment illustrated, gripping means 16 includes a plurality of grippers shown in the form s shown in the form of circumferentially spaced bullet-shaped slugs 17 secured within bores formed on rounded surface 11' of pusher block 10. Although FIG. 3 illustrates four equally spaced slugs 17, it should be understood that any desired number thereof could be utilized, so long as the herein described desired functions of the pusher block are achieved thereby. Slugs 17 may be secured on pusher block 10 by any desired process, such as by silver soldering.

Slugs 17 may be composed of any suitable steel material, such as an H13 tool steel having a pre-relieved hardness approximating Rockwell C50-50 and a post-relieved hardness approximating Rockwell C44-47. The material composing slugs 17 is preferably harder than the hardness of the workpiece. Pusher block 10 proper is preferably composed of the modified medium carbon low alloy steel having a hardness approximating rockwell C28-32. In one specific example, the material composing pusher block 10 comprised, by weight, 0.43% C, 1.1% Mn, 0.3% Si, 0.3% Mo, 1.0% Cr, 0.2% V, and the remainder iron.

Subsequent to the securance of slugs 17 on pusher block 10, the assembly is preferably stress-relieved by subjecting it to a temperature in the range of from 800°–900° F. for approximately two hours, for example. The composition of workpiece W will, of course, depend upon the particular application involved. For example, in one specific application the workpiece constituted a track roller shaft (composed of SAE 1042 carbon steel), unhardened, having a Rockwell B hardness approximating 80–95.

INDUSTRIAL APPLICABILITY

Pusher block 10 finds particular application in rotary forging machines wherein it is desired to upset forge a portion of a cylindrical workpiece, such as a track roller shaft. As shown in FIG. 4, such a machine includes a pair of opposed dies D (one shown) which force selected portions of the workpiece material into the desired shape by a series of short, rapid strokes. Simultaneously therewith, feed housing F will move the workpiece axially leftwardly in FIG. 4 at a predetermined rate to effect the desired forging process. In conventional methods of this type, cycle time for forming a reduced end on a track roller shaft has been found to approximate 110 seconds, whereas pusher block 10 and the method accomplished thereby, embodying this invention, reduced such cycle time to approximately 47 seconds, i.e. less than half.

Referring to FIG. 2, the method steps of this invention are carried forth by first securing pusher block 10 to a rotatable spindle S by a plurality of bolts B. Note that the chuck arms have been removed from the machine to reduce the longitudinal distance between the feed housing and the forging dies. Recesses 15 are provided on the pusher block to accommodate a socket wrench to tighten the bolts down. A reduced diameter portion R of workpiece W, shown in the form of a track roller shaft, is then inserted into pusher block 10 to engage an annular shoulder W' thereof with slugs 17 comprising gripping means 16. Spindle S and pusher block 10 are then rotated to, in turn, rotate workpiece W while simultaneously maintaining a gripping force therebetween at gripping means 16 to prevent relative rotational slippage between the pusher block and workpiece.

Simultaneously therewith, workpiece is moved rightwardly in FIG. 2 in the direction of arrow A by feed housing F (FIG. 4), spindle S, and pusher block 10 to move the opposite end of the workpiece axially between the pair of radially movable forming guides D. The dies are reciprocated in the above-described manner to upset forge portions W'' of the workpiece to form them into the desired shape. It should be understood that gripping means 16 could take forms other than slugs 17 to effect the desired non-slippage function. For example, spot welds or segments of a standard hacksaw blade could be suitably secured to pusher block and substituted in lieu of slugs 17. In one application wherein spot welds were employed, the welds were composed of WELCO No. 240, manufactured by Thermacote-Welco Co. of Pasadena, Calif. Such composition is similar to air-hardened tool steel and has an as-deposited hardness approximating Rockwell C43-50, which is preferably harder than the hardness of the workpiece.

Other aspects, objects, and advantages of this invention can be obtained from a study of the drawings, the disclosure, and the appended claims.

I claim:

1. A pusher block (10) for rotary forging machines comprising a tubular portion (11), attachment means (12), adjacent a first end of said tubular portion, for detachably securing said pusher block to a rotating spindle (S) of a rotary forging machine, and gripping means (16), fixedly secured on a second end of said tubular portion, for moving a workpiece (W) axially and for simultaneously frictionally gripping the periphery of said workpiece and rotating said workpiece upon rotation of said spindle to prevent relative rotation between said pusher block and said workpiece.

2. The pusher block of claim 1 wherein said attachment means includes a radial flange (13) having a plurality of circumferentially disposed bolt holes (14) formed therethrough.

3. The pusher block of claim 1 wherein said gripping means includes a plurality of circumferentially disposed grippers (17) secured adjacent the second end of said tubular portion.

4. The pusher block of claim 3 further including an annular surface (11') defined on the second end of said tubular portion, said grippers secured in axial disposition on said annular surface to extend therepast.

5. The pusher block of claim 3 wherein each of said grippers includes a slug.

6. The pusher block of claim 3 wherein said grippers are equally spaced circumferentially within the tubular portion of said pusher block.

7. A method for forging a workpiece (W) having a reduced diameter portion (R) formed on an end thereof to define an annular shoulder (W') comprising the steps of gripping said workpiece at the annular shoulder (W') thereof with a pusher block (10) while simultaneously mounting the reduced diameter portion (R) of said workpiece (W) within said pusher block (10), rotating said pusher block to rotate said workpiece while simultaneously maintaining a frictional gripping force therebetween to prevent relative rotational slippage, moving said workpiece axially (A) between a pair of radial movable forming dies (D), and upsetting a portion (W'') of said workpiece by reciprocating said dies radially into engagement with said workpiece.

8. The method of claim 7 wherein said gripping step includes engaging the annular shoulder of said workpiece with a plurality of circumferentially disposed grippers (17) secured on said pusher block.

9. The method of claim 8 wherein said moving step includes the step of engaging the shoulder of said workpiece with said grippers.

* * * * *